US005481239A

United States Patent [19]

Di Troia

[11] Patent Number: 5,481,239

[45] Date of Patent: Jan. 2, 1996

[54] LIMITER INDICATOR

[75] Inventor: Gary W. Di Troia, Nashua, N.H.

[73] Assignee: Burndy Corporation, Norwalk, Conn.

[21] Appl. No.: 286,170

[22] Filed: Aug. 5, 1994

[51] Int. Cl.[6] ..... H01H 85/30; H01R 13/68; H01R 4/00

[52] U.S. Cl. ..... 337/206; 337/241; 337/244; 439/622; 174/84 C; 174/84 R

[58] Field of Search ..... 337/203, 206, 337/241, 242, 243, 244, 265, 267, 332, 376, 415; 439/250, 622, 893

[56] References Cited

U.S. PATENT DOCUMENTS

| | | | |
|---|---|---|---|
| 863,656 | 8/1907 | Reynolds . | |
| 1,005,517 | 10/1911 | Daum . | |
| 3,519,971 | 7/1970 | Cameron | 337/241 |
| 3,551,869 | 12/1970 | Robinson | 337/201 |
| 3,946,351 | 3/1976 | Bronikowski | 337/224 |
| 4,016,521 | 4/1977 | Seybold | 337/241 |
| 4,648,674 | 3/1987 | Sanchez . | |
| 5,113,169 | 5/1992 | Ruehl | 337/265 |
| 5,319,344 | 6/1994 | Mosesian | 337/244 |

FOREIGN PATENT DOCUMENTS

| | | | |
|---|---|---|---|
| 2072419 | 1/1993 | Canada | 337/332 |
| 420351 | 4/1991 | European Pat. Off. | 337/206 |
| 2591030 | 6/1987 | France | 337/244 |
| 1193155 | 7/1958 | Germany | 337/244 |
| 2189095 | 10/1987 | United Kingdom | 337/206 |

*Primary Examiner*—Leo P. Picard
*Assistant Examiner*—Stephen T. Ryan
*Attorney, Agent, or Firm*—Burtsell J. Kearns; Patrick J. Walsh

[57] ABSTRACT

Limiters for protection against fault currents in electrical distribution networks the limiter having externally visible indicator for indicating that a limiter element has fused and which visible indicator may be reset and reused after a fused limiter is replaced.

6 Claims, 1 Drawing Sheet

LIMITER INDICATOR

BACKGROUND OF THE INVENTION

The present invention relates to limiters for protection against fault currents in electrical distribution networks, and particularly to limiters having indicators for revealing that a fault current has vaporized a fusible element of the limiter.

The chief purposes of network protection are to interrupt fault currents before damage occurs to cable insulations and associated equipment, and to eliminate service interruptions. There are two principal kinds of fault currents: high energy arcing faults and sustained faults. The arcing fault is more common and can sputter briefly before clearing. The arcing fault can also be of such duration as to "roast" the insulation. A sustained fault occurs when two conductors contact solidly with each other and induce the flow of heavy short circuit currents. Suitable protection in the form of limiters is required to prevent damage to cable insulation, combustible fumes, fire and explosion caused by fault currents. Accordingly limiters are installed at each end of cable sections and are selected according to specific time-current characteristics to avoid unnecessary outages. In this way limiters act to confine fault current damage to the section of cable where the fault occurs.

When limiters are installed in electric distribution networks, particularly underground networks, the limiter element and cable ends are securely covered. The insulating covering, with joints wrapped in tape, prevents easy identification of a particular limiter which has operated, among many in the distribution network. The task of finding a limiter which has operated or fused involves the tedious and time consuming task of uncovering and recovering a series of limiter assemblies.

Many techniques for blown fuse indication have been developed and include spring loaded indicators, visual windows, color changes and pressure dependent indication. All pressure indicators thus far have been destructive, single use operating devices. Expulsion fuses discharge a weighted indicator designed to remove energy from the circuit and relieve internal pressure. The total fuse must be replaced. U.S. Pat. No. 4,016,521 to Seybold discloses an overpressure limiter indicator including a plastic wall which melts and is forced out by internal pressure caused by limiter fusing. The Seybold device allows a single use because the unit including fusible link and housing is permanently altered to indicate limiter operation and must be removed and replaced for the circuit to be reset.

SUMMARY OF THE INVENTION

The present invention comprises an insulating sleeve with externally visible means for indicating that a limiter has fused or operated and which may be reset and reused after a fused limiter is replaced.

In a preferred embodiment of the invention, the insulating sleeve is formed of a suitable insulating material such as molded rubber and is provided with a molded-in blister to act as an indicator. The blister is positioned on the sleeve for location adjacent the limiter when the sleeve insulating assembly is installed in a network. When installed, the blister is manually pressed inwards for providing visual indication that the limiter within the insulating sleeve is functioning normally.

When a fault current occurs and the limiter fuses, the element is vaporized. Vaporization causes increased internal gas pressure within the sleeve assembly forcing the blister outward thereby providing external visual indication that the limiter element has fused.

A bright coloring of the blister allows for easy visual identification of the faulty element.

In an alternate embodiment of the invention, the blister is a separately made insert which is fitted through a prepared hole in the insulating sleeve wall. The blister has a domed top wall which is depressed manually during insulating sleeve assembly. The insert blister operates on the same principle as the molded-in blister and pops out when vaporization of the element occurs within the insulating sleeve.

The limiter indicator according to the invention may be reset and reused so that the fusible link is the only portion of the limiter assembly requiring replacement. Once the fused link is replaced, the original components of the limiter including the shell and insulator sleeve with indicator are reassembled, and the indicator reset.

OBJECTS OF THE INVENTION

It is an object of the invention to provide an insulating sleeve assembly for network limiters with means for visual indication of limiter operation that is resettable and reusable.

It is another object of the invention to provide an insulating sleeve assembly for network limiters with an integral blister normally depressed which changes shape to give visual indication of limiter fusing.

It is a further object of the invention to provide an insulating sleeve assembly for network limiters with a separate blister insert for visual indication of limiter operation.

It is a further object of the invention to provide an insulating sleeve assembly for network limiters with a brightly colored blister for ease of visual indication of limiter fusing.

Other and further objects of the invention will occur to one skilled in the art with an understanding of the following detailed description of the invention or upon employment of the invention in practice.

DESCRIPTION OF THE DRAWING

A preferred embodiment of the invention has been chosen for purposes of illustrating the construction and operation of the invention and is shown in the accompanying drawing in which.

DETAILED DESCRIPTION OF THE INVENTION

Figure 1:
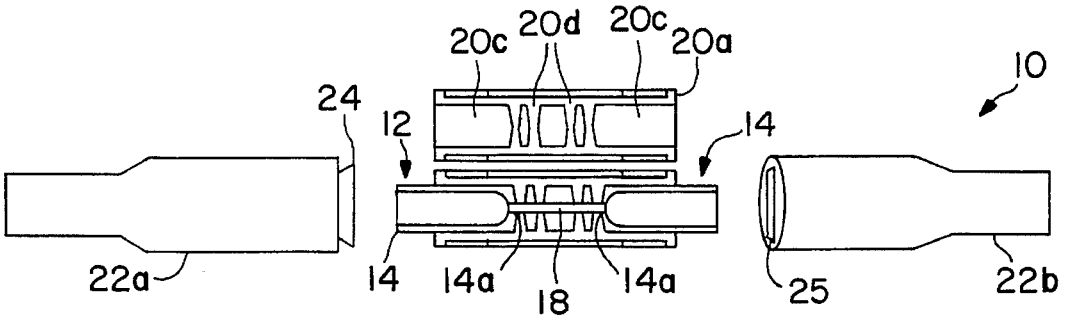
FIG. 1 is an exploded view of the components of a limiter assembly.

Referring now to the drawing the limiter 10 according to the invention comprises a fusible limiter link 12 having axially aligned, outwardly open receptacles 14 for receiving and crimping cable ends 16 forming part of a distribution network. The receptacles are physically and electrically connected at their inner closed ends by means of an integral strip 18 defining a fusible element. The fusible element vaporizes in the event a fault current occurs in connected cables 16 in excess of the element's time-current characteristic.

The fusible limiter link is encased in a generally cylindrical open ended composition shell halves 20*a*, 20*b* having spaced cavities 20*c* and internal fingers 20*d* for accommodating and positioning the fusible element 18.

A pair of insulating sleeves 22*a*, 22*b* preferably formed of rubber entirely cover the cable, fusible link, and composition shell subassembly. A suitable connecting joint such as a circular dovetail 24 is provided at the inner ends 25 of cooperating sleeves.

Figure 2:
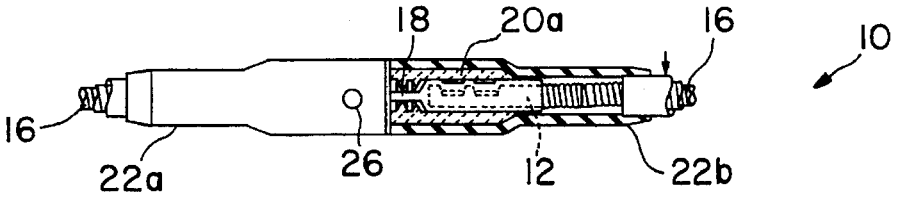
FIG. 2 is a plan view partly in section of a limiter assembly.
Figure 3:
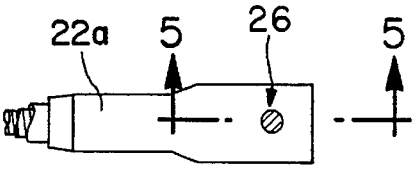
FIG. 3 is a plan view of an insulating sleeve showing a limiter indicator.
Figure 4:
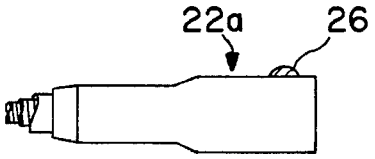
FIG. 4 is a side elevational view of the sleeve of FIG. 3.
Figure 5:
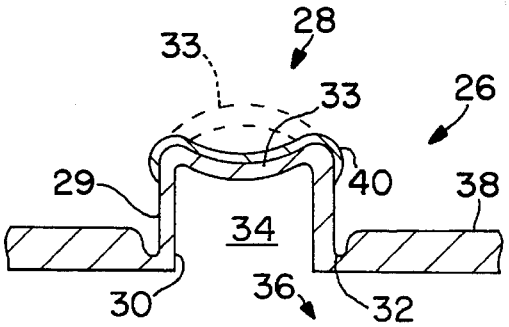
FIG. 5 is an enlarged section view of the limiter indicator taken along line 5—5 of FIG. 3.

The limiter assembly is shown in FIG. 2.

In accordance with the invention, one of the insulating sleeves 22*a* is provided with means 26 for visually indicating fusion of the limiter element with such means being resettable and reusable after the occurrence of one or more fault currents through the limiter assembly. As shown in FIGS. 3–6, one of the insulating sleeves is provided with indicating means in the form of a gas impervious molded-in blister or projection 28 preferably in the form of an inverted cylindrical cup with upstanding cylindrical wall 29 attached at its open end 30 to the sleeve wall by means of a ring 32. The blister includes an outer dome 33 which together with the wall 29 define an interior chamber 34 communicating with the interior of the limiter assembly 36. The diameter, wall thickness, and height of the blister are selected to enable the blister at full height to project above the outer surface 38 of its host sleeve, and to be supple enough to be manually depressed or folded in on itself and remain in depressed configuration shown by solid lines of dome 33 in FIG. 5 until activated by a fused element. In practice, the sleeve part 22*a* and the projection 28 are molded integral of a suitable rubber or like composition. The outer surface of the blister may have a brightly colored coating 40 to aid visual indication of blister position and limiter condition.

Figure 6:
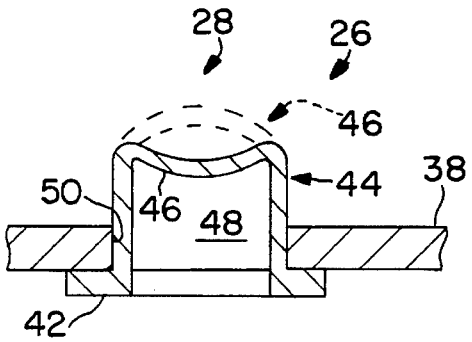
FIG. 6 is an enlarged sectional view of an alternate embodiment of limiter indicator according to the invention.

A modification of the invention is shown in FIG. 6 in which the means for visually indicating fusion is a separately molded blister 28 comprising an annular rim 42 and a generally cylindrical side wall 44 terminating in a dome 46. The blister defines an interior chamber 48 in communication with the interior 36 of the limiter assembly. The modified blister is inserted in a receptor hole 50 provided in the insulating sleeve wall 38.

In operation, the limiter assembly is installed between adjacent cables comprising part of a distribution network. The normal position of the indicating blister is the depressed position shown in full lines in FIGS. 5 and 6. This position is imparted to the blister by the installer who simply presses the blister in upon itself. In the event a fault current occurs exceeding the time-current characteristic of the limiter, the element vaporizes creating internal gas pressure within the limiter assembly which enters the blister chamber causing the blister to pop out to a full height or blown position of dash lines in FIGS. 5 and 6.

The operation of the modified blister is substantially the same.

I claim:

1. A limiter indicator for an electrical distribution system having a plurality of cables comprising a fusible element having receptacles for receiving and connecting the ends of adjacent network cables, a composition shell encasing the fusible element, an insulating sleeve covering the shell, cable ends, and fusible element and together therewith defining a limiter assembly, the insulating sleeve having resettable and resuable means communicating with the interior of the limiter assembly, said means having a normal position for visually, indicating that the fusible element is whole, and a blown position visually indicating that the fusible element has vaporized.

2. A limiter indicator for an electrical distribution system having a plurality of cables comprising a fusible element having receptacles for receiving and connecting the ends of adjacent network cables, a composition shell encasing the fusible element, an insulating sleeve covering the shell, cable ends, and fusible element and together therewith defining a limiter assembly, the insulating sleeve having resettable and reusable means communicating with the interior of the limiter assembly, said means having a normal, depressed position for visually indicating that the fusible element is whole, and a blown position caused by gas pressure generated by fusing of the limiter element for visually indicating that the fusible element has vaporized.

3. A limiter indicator for an electrical distribution system having a plurality of cables comprising a fusible element having receptacles for receiving and connecting the ends of adjacent network cables, a composition shell encasing the fusible element, an insulating sleeve covering the shell, cable ends, and fusible element and together therewith defining a limiter assembly, the insulating sleeve having an integral enclosed upwardly extending cup-shaped projection communicating with the interior of the limiter assembly, said projection being formed of the same material as the insulating sleeve and having supple side walls, the projection having a first depressed position for visually indicating that the fusible element is intact, and a second blown position caused by gas pressure generated by limiter fusion in the assembly interior thereby visually indicating that the fusible element has vaporized, the projection being resettable to the first position after reassembling the limiter assembly with a fresh fusible element.

4. A limiter indicator as defined in claim 1 in which the resettable and reusable means comprises a separate cup shaped member inserted into an opening in the insulating sleeve.

5. A limiter indicator as defined in claim 1 in which the resettable and reusable means is brightly colored.

6. A limiter indicator as defined in claim 3 in which the insulating sleeve comprises two parts interlocked over the limiter assembly and with the projection formed into one part of the sleeve.

* * * * *